US008573105B2

(12) United States Patent
Schneider et al.

(10) Patent No.: US 8,573,105 B2
(45) Date of Patent: Nov. 5, 2013

(54) PAPER PUNCH

(75) Inventors: Thomas Schneider, Leonberg (DE); Ulrich Schneider, Stuttgart (DE); Kurt Leute, Blumberg (DE)

(73) Assignee: Esselte Leitz GmbH & Co KG, Stuttgart (DE)

( * ) Notice: Subject to any disclaimer, the term of this patent is extended or adjusted under 35 U.S.C. 154(b) by 319 days.

(21) Appl. No.: 12/737,413

(22) PCT Filed: Jun. 16, 2009

(86) PCT No.: PCT/EP2009/057419

§ 371 (c)(1),
(2), (4) Date: Jan. 11, 2011

(87) PCT Pub. No.: WO2010/006865

PCT Pub. Date: Jan. 21, 2010

(65) Prior Publication Data

US 2011/0107893 A1 May 12, 2011

(30) Foreign Application Priority Data

Jul. 17, 2008 (DE) ..... 10 2008 033 606

(51) Int. Cl.
*B26F 1/14* (2006.01)
*B26F 1/02* (2006.01)

(52) U.S. Cl.
USPC ..... 83/633; 83/167

(58) Field of Classification Search
USPC ..... 83/633, 167, 618, 698.91, 687, 627, 83/623, 599, 549, 691; 234/98; 30/364; D19/72
See application file for complete search history.

(56) References Cited

U.S. PATENT DOCUMENTS

| | | | | |
|---|---|---|---|---|
| 3,859,726 | A | 1/1975 | Mitsunari | |
| 5,632,188 | A * | 5/1997 | Karlis | 83/167 |
| 6,439,093 | B1 * | 8/2002 | Davies | 83/687 |
| 2007/0051221 | A1 * | 3/2007 | Corcoran et al. | 83/628 |
| 2008/0236357 | A1 * | 10/2008 | Wu | 83/613 |

FOREIGN PATENT DOCUMENTS

| | | |
|---|---|---|
| CN | 2415896 Y | 1/2001 |
| DE | 461 552 | 6/1928 |
| DE | 706 832 | 6/1941 |
| DE | 199 12 042 | 9/2000 |
| DE | 199 12 043 | 9/2000 |
| DE | 10 2006 027 009 | 12/2007 |

(Continued)

OTHER PUBLICATIONS

International Search Report.

(Continued)

*Primary Examiner* — Ghassem Alie
(74) *Attorney, Agent, or Firm* — Collard & Roe, P.C.

(57) ABSTRACT

A paper punch includes a base part which has a positioning surface on the bottom side thereof for positioning the same on a table top. At least two punching tools are displaceably supported with respect to the base part to punch holes into documents. A hand-held applies pressure on the punching tools and is supported about a pivot axis in a limited pivoting manner by way of a front region of the base part. The base part has a grip cutout which is open toward the rear side of the base part and which is delimited toward the top by a ceiling wall extending at a distance from the positioning surface and toward the front by a transverse wall.

8 Claims, 2 Drawing Sheets

(56) References Cited

FOREIGN PATENT DOCUMENTS

Figure 1:
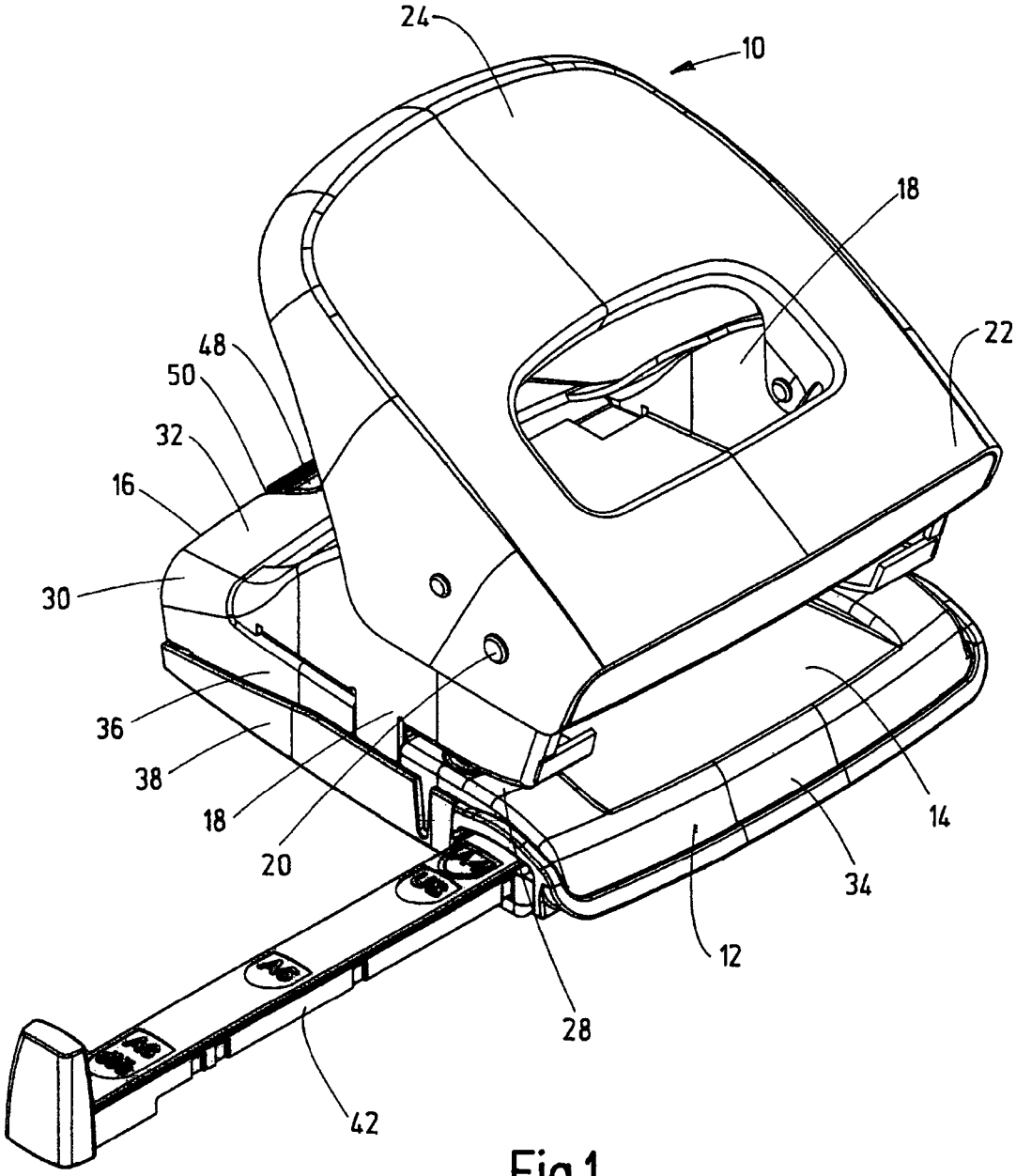

| | | |
|---|---|---|
| EP | 1 332 846 | 8/2003 |
| FR | 2 228 584 | 12/1974 |
| JP | 2003-245896 | 9/2003 |
| WO | WO 2007/038439 | 4/2007 |

OTHER PUBLICATIONS

German Search Report dated Mar. 17, 2009 with English translation of relevant parts.
International Search Report of PCT/EP2009/057419 mailed Sep. 21, 2009.

* cited by examiner

PAPER PUNCH

CROSS REFERENCE TO RELATED APPLICATIONS

This application is the National Stage of PCT/EP2009/057419 filed on Jun. 16, 2009, which claims priority under 35 U.S.C. §119 of German Application No. 10 2008 033 606.8 filed on Jul. 17, 2008, the disclosure of which is incorporated by reference. The international application under PCT article 21(2) was not published in English.

The invention relates to a paper punch in accordance with the preamble of claim 1.

Known paper punches have a base part on which the document(s) to be punched is/are laid down onto a contact surface. Above the base part, a hand lever is mounted so as to pivot about a pivot axle, in restricted manner, which lever serves for pressing down punching tools, such as hole punches or hollow hole punches. The punching tools are mounted to be displaceable, for example in side cheeks that carry the pivot axle of the hand lever and extend upward from the base part, and punch round paper scraps out of the document(s) lying on the contact surface when the hand lever is pressed down, which scraps are pressed through holes in the contact surface, into a scrap trough of the base part. During the punching process, the paper punch is either standing on a flat surface, for example a table top, with a positioning surface on the underside of its base part, and the user presses down on the free end of the hand lever, which end projects in the direction of the rear side of the base part. In this type of use, the muscle groups of the upper arm and the upper body of the user are predominantly stressed, whereby the user must exert great force because of the long lever arm formed by his arm. Often, it is necessary for the user to stand up and thus be enabled to support himself on the lever arm with his weight. Another type of use consists in taking the paper punch into one's hand, whereby the fingers engage on the positioning surface and the heel of the hand engages on the free end of the hand lever. During the punching process, the muscle groups of the hand and the lower arm are then predominantly in use, whereby the user can exert great force, even when sitting. However, in the case of the known punches, the base part of which lies on the table top with its entire underside, this simpler handling is perceived as being disadvantageous, since both hands generally have to be used to pick up the paper punch.

It is therefore the task of the invention to further develop a paper punch of the type stated initially, in such a manner that it is easier to handle.

This task is accomplished, according to the invention, by means of a paper punch having the characteristics of claim 1. Advantageous further developments of the invention are the object of the dependent claims.

The invention is based on the idea that the user can grip into the grip cutout of the base part with his fingers, while the heel of the hand engages on the free end of the hand lever. Thus, it is possible to grip under the base part, in simple manner, even if the paper punch is standing on a table top. Furthermore, the distance from the ceiling wall to the free end of the hand lever is less than that from the positioning surface to the free end of the hand lever, so that a punching process in which the paper punch is held by hand can be carried out even by users who have smaller hands. Furthermore, the paper punch can remain standing on the table top even during the punching process, so that use of the muscle groups of the hand and the lower arm can be combined with use of the muscle groups of the upper arm and the upper body, for punching procedures for which greater forces are required.

It is advantageous if the grip cutout has a height of at least 10 mm, preferably at least 15 mm. The height of the grip cutout is measured from a plane that runs through the positioning surface, which corresponds to the plane of the table top, in the vertical direction. By means of this measure, the user's fingers can easily be introduced into the grip cutout when the punch is still standing on the table top. It is also advantageous if the grip cutout has a width of at least 70 mm, preferably at least 80 mm. The width is measured in the horizontal direction, parallel to the pivot axle of the hand lever. By means of this measure, it is made possible for the user to introduce all his fingers, with the exception of the thumb, into the grip cutout. Preferably, the grip cutout extends over the entire width of the base part.

It is practical if the grip cutout is delimited on the side by side walls of the base part that extend in the direction toward the rear side. Slipping of the fingers to the side is thereby prevented. Preferably, the base part has a lower punch part that has the ceiling wall, made of sheet metal, and a scrap trough that has the positioning surface, made of plastic, whereby the scrap trough and the lower punch part are releasably connected with one another. This allows easy emptying of the scrap trough. It is practical if the transverse wall is an integral part of the scrap trough, and a center part of the transverse wall is preferably domed forward. In this way, account is taken of the fact that the middle fingers are longer than the outer fingers.

It is practical if the ceiling wall has a cutout with an open edge, into which a part of the scrap trough engages. The user can grip at this location, in order to remove the scrap trough from the lower punch part. It is advantageous if the grip cutout is lined with a continuation of the scrap trough that lies against the ceiling wall and, if necessary, against the side walls. The user then grips the continuation of the scrap trough, which consists of plastic, preferably a soft plastic, and this is perceived as being more comfortable than if he had to grip on the ceiling wall, which is formed from sheet metal.

In the following, the invention will be explained in greater detail using an exemplary embodiment shown schematically in the drawing. This shows:

FIG. 1 a paper punch in a perspective view, at a slant from the front, and

Figure 2:
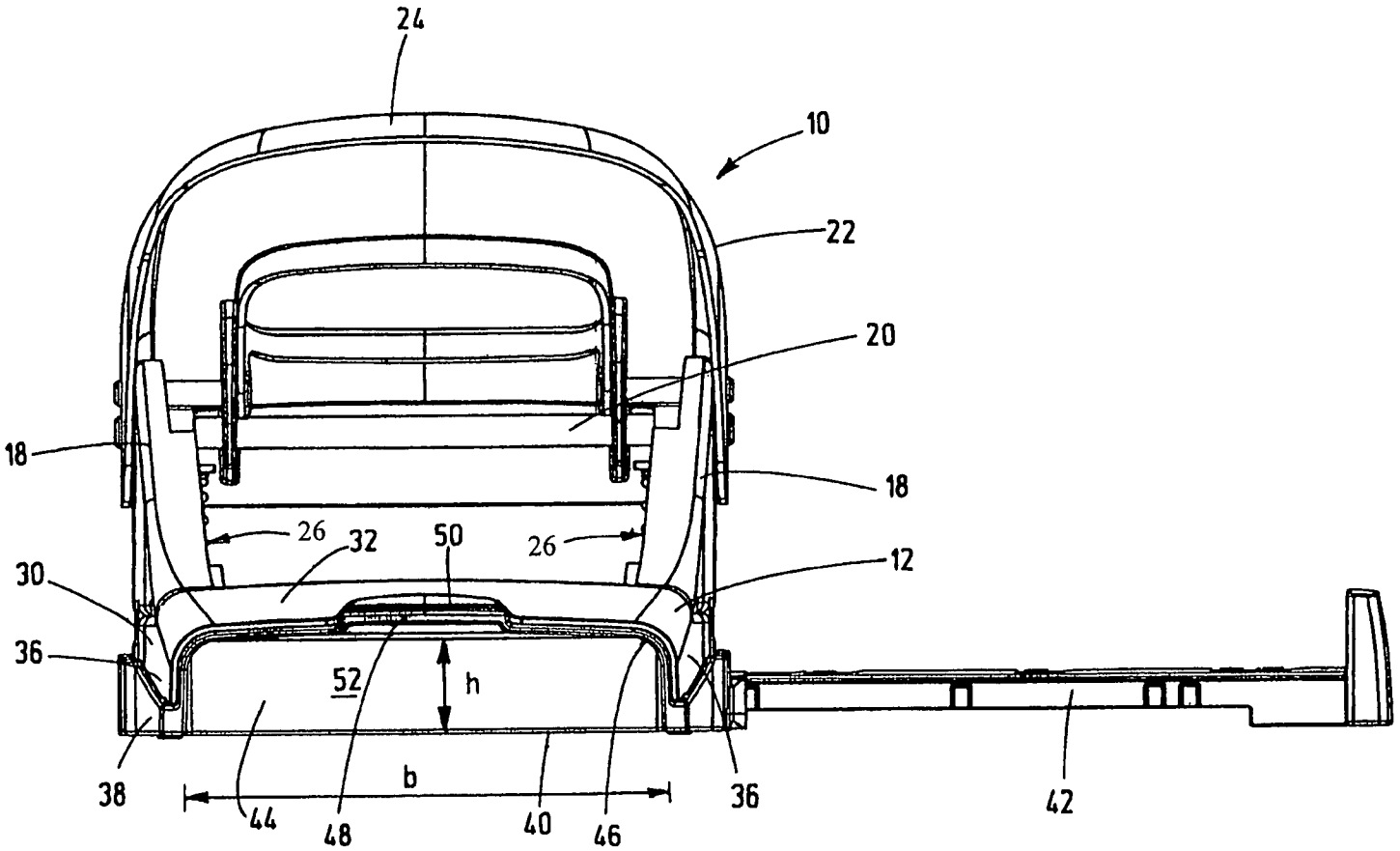

FIG. 2 the paper punch according to FIG. 1 in a view from the rear.

The paper punch 10 shown in the drawing has a base part 12, from which two side cheeks 18 that run at a distance from one another extend upward, from its front region 14, in the direction toward its rear side 16. A pivot axle 20 is mounted in the side cheeks 18, about which a hand lever 22 can pivot in restricted manner. The free end 24 of the hand lever 22 extends at a distance from the base part 12, upward, at a slant, in the direction of its rear side 16. By means of pressing down the free end 24 of the hand lever 22 in the direction of the base part 12, two hole punches 26 that are mounted in the side cheeks 18, in displaceable manner, have power applied to them, and punch round paper scraps out of a document/documents lying on a contact surface 28 in the front region 14 of the base part 12.

The base part 12 has a lower punch part 30 made of sheet metal, which has a ceiling wall 32 as well as side walls 36 that are bent away downward relative to the ceiling wall 32 and extend from a front side 34 toward the rear side 16. In the front region 14, the ceiling wall 32 is provided with the contact surface 28 for the document(s). As a further component of the base part 12, a scrap trough 38 made of soft plastic is engaged onto the lower punch part 30, from the bottom, which trough has a flat positioning surface 40 on its underside, for positioning the paper punch 10 on a table top. The scrap trough 38 is engaged onto the lower punch part 30 and, together with this part, forms an accommodation space for the punched-out paper scraps, which are pressed through holes in the contact surface 28 by the hole punches 26. A stop rail 42 is displaceably guided in the scrap trough 38, which rail facilitates positioning of the document(s) on the contact surface 28.

The base part 12 has a grip cutout 44 that is open toward its rear side 16, which cutout is delimited toward the top by the rearward end of the ceiling wall 32 and toward the sides by the rearward ends of the side walls 36. The grip cutout 44 is lined by a continuation 46 of the scrap trough 38, which lies against the inner surfaces of the ceiling wall 32 and the side walls 36. A part 48 of the scrap trough 38 is furthermore engaged into a cutout 50 of the ceiling wall 32 close to the edge, and can easily be grasped to release the connection between the lower punch part 30 and the scrap trough 38. Toward the front, the grip cutout 44 is delimited by a transverse wall 52 of the scrap trough 38, which furthermore delimits the accommodation space for the paper scraps toward the rear. The transverse wall 52 is domed toward the front at its center, between the side walls 36.

A user can engage into the grip cutout 44 with four fingers, in order to hold the paper punch 10 in such a manner that he can press the free end 24 of the hand lever 22 downward with the heel of his hand. For this purpose, the grip cutout 44 has a height h of approximately 15 mm, which is measured between the plane that runs through the positioning surface 40 and the continuation 46 of the scrap trough 38 that lies against the inner side of the ceiling wall 32. The width b of the grip cutout 44 amounts to approximately 80 mm between the parts of the continuation 46 that lie against the inner surfaces of the side walls 36. The side cheeks 18 extend to approximately the transverse wall 52 and become flatter toward the rear, so that they have an appealing design.

In summary, the following should be stated:

The invention relates to a paper punch 10 having a base part 12, which has a positioning surface 40 for being set onto a table top, on its underside, having at least two punch tools 26, which are mounted to be vertically displaceable with regard to the base part 12, for punching a document/document(s), and having a hand lever 22 for applying force to the punch tools 26, which lever is mounted so as to pivot, in restricted manner, about a pivot axle 20, over a front region 14 of the base part 12 that has a contact surface 28 for the document(s), and the free end 24 of which extends at a distance from the base part 12, in the direction to a rear side 16 of the base part 12. According to the invention, it is provided that the base part 12 has a grip cutout 44 that is open toward its rear side 16, and is delimited toward the top by a ceiling wall 32 that runs at a distance from the positioning surface 40, and toward the front by a transverse wall 52.

The invention claimed is:

1. A paper punch comprising:

(a) a base part, said base part comprising an underside, a positioning surface for being set onto a table top on the underside, a front region having a contact surface for a document, a rear side, a ceiling wall running at a distance from the positioning surface, a transverse wall, side walls extending toward the rear side, and a grip cutout;

(b) at least two punch tools for punching a document and mounted to be vertically displaceable with regard to the base part; and (c) a hand lever for applying force to the at least two punch tools, said hand lever being mounted so as to pivot about a pivot axle over the front region of the base part, said hand lever having a free end extending at a distance from the base part in a direction to the rear side of the base part;

wherein the grip cutout is open towards the rear side, is delimited upwards by the ceiling wall, frontwards by the transverse wall, and laterally by the side walls, has a height of at least 10 mm, and has a width of at least 70 mm;

wherein the base part has a lower punch part made of sheet metal, the lower punch part having the ceiling wall, and a scrap trough made of plastic, the scrap trough having the positioning surface;

wherein the scrap trough and the lower punch part are releasable connected with one another;

wherein the ceiling wall has a cutout with an open edge; and wherein a part of the scrap trough engages into the cutout of the ceiling wall.

2. The paper punch according to claim 1, wherein the grip cutout has a height of at least 15 mm.

3. The paper punch according to claim 1, wherein the grip cutout has a width of at least 80 mm.

4. The paper punch according to claim 1, wherein the grip cutout extends over the entire width of the base part.

5. The paper punch according to claim 1, wherein the transverse wall is an integral part of the scrap trough.

6. The paper punch according to claim 1, wherein a center part of the transverse wall is domed forward.

7. A paper punch comprising:

(a) a base part, said base part comprising an underside, a positioning surface for being set onto a table top on the underside, a front region having a contact surface for a document, a rear side, a ceiling wall running at a distance from the positioning surface, a transverse wall, side walls extending toward the rear side, and a grip cutout;

(b) at least two punch tools for punching a document and mounted to be vertically displaceable with regard to the base part; and (c) a hand lever for applying force to the at least two punch tools, said hand lever being mounted so as to pivot about a pivot axle over the front region of the base part, said hand lever having a free end extending at a distance from the base part in a direction to the rear side of the base part;

wherein said grip cutout is open towards the rear side, is delimited upwards by the ceiling wall, frontwards by the transverse wall, and laterally by the side walls, has a height of at least 10 mm, and has a width of at least 70 mm;

wherein the base part has a lower punch part made of sheet metal, the lower punch part having the ceiling wall, and a scrap trough made of plastic, the scrap trough having the positioning surface;

wherein the scrap trough and the lower punch part are releasably connected with one another;

wherein the scrap trough has a continuation lying against the ceiling wall; and wherein the grip cutout is lined by the continuation of the scrap trough.

8. The paper punch according to claim 7, wherein the continuation of the scrap trough also lies against the side walls of the base part.

* * * * *